United States Patent [19]

Steidinger

[11] 4,380,315

[45] Apr. 19, 1983

[54] MAILER

[75] Inventor: Donald J. Steidinger, Barrington, Ill.

[73] Assignee: Wallace Computer Services, Inc., Hillside, Ill.

[21] Appl. No.: 224,926

[22] Filed: Jan. 14, 1981

[51] Int. Cl.[3] ..... B65D 27/10

[52] U.S. Cl. ..... 229/69; 206/610; 229/73

[58] Field of Search ..... 229/69, 73; 206/610

[56] References Cited

U.S. PATENT DOCUMENTS

| | | | |
|---|---|---|---|
| Re. 30,114 | 10/1979 | Juszak et al. | 206/610 |
| 2,338,922 | 1/1944 | Fleming | 229/69 |
| 3,476,307 | 11/1969 | Faltin et al. | 229/69 |
| 3,482,780 | 12/1969 | Johnson | 229/69 |
| 3,507,519 | 4/1970 | McNabb | 229/73 |
| 3,523,638 | 8/1970 | Moonan | 229/92.1 |
| 3,554,438 | 1/1971 | Van Malderghem | 229/73 |
| 3,837,565 | 9/1974 | Johnson | 206/610 |
| 3,854,654 | 12/1974 | Van Malderghem | 229/69 |
| 3,902,655 | 9/1975 | Huffman | 206/610 |
| 3,955,750 | 5/1976 | Huffman | 229/69 |
| 4,002,290 | 1/1977 | Van Malderghem | 229/69 |
| 4,010,889 | 3/1977 | Allen et al. | 206/610 |
| 4,239,114 | 12/1980 | Denay | 206/610 |

FOREIGN PATENT DOCUMENTS

| | | | |
|---|---|---|---|
| 991639 | 5/1965 | United Kingdom | 229/69 |
| 1159725 | 7/1969 | United Kingdom | 229/69 |
| 1513309 | 6/1978 | United Kingdom | 206/610 |

*Primary Examiner*—William Price
*Assistant Examiner*—Gary E. Elkins
*Attorney, Agent, or Firm*—Tilton, Fallon, Lungmus & Chestnut

[57] ABSTRACT

A connected series of mailer units separable into individual units and foldable for mailing into a size small enough to avoid bending, tearing, etc., while including an information ply of a length approximating that of the outer envelope and having tear strip means affording removal of the information ply while the same is in folded condition.

22 Claims, 22 Drawing Figures

FIG. 1
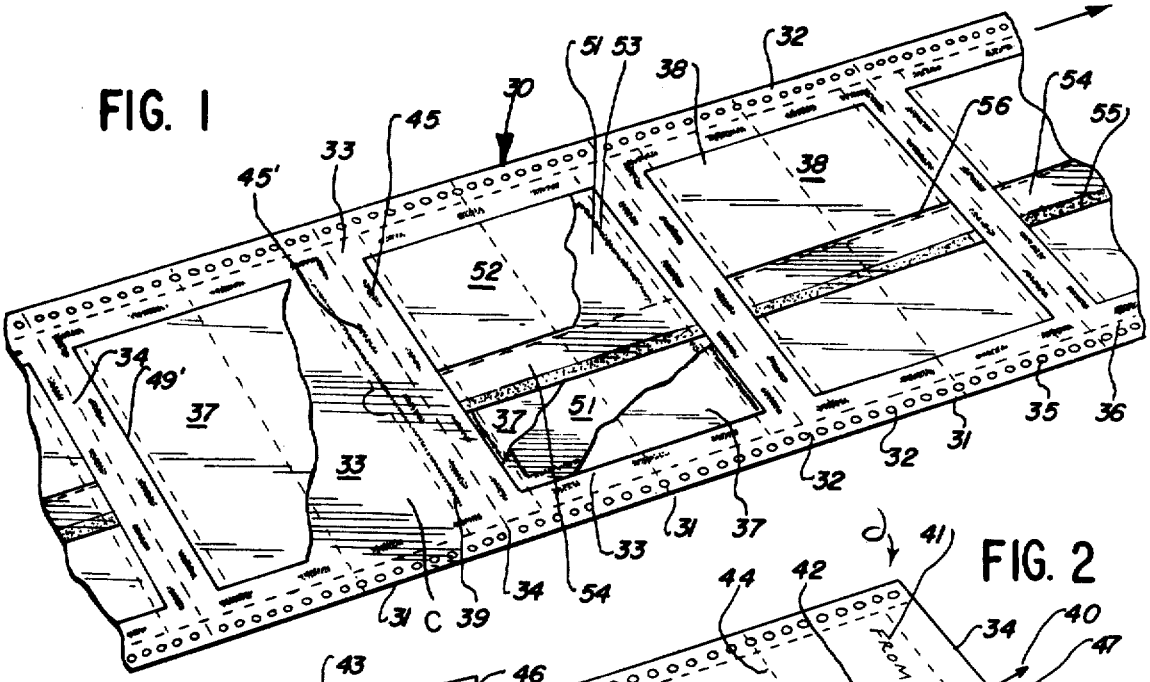
FIG. 2
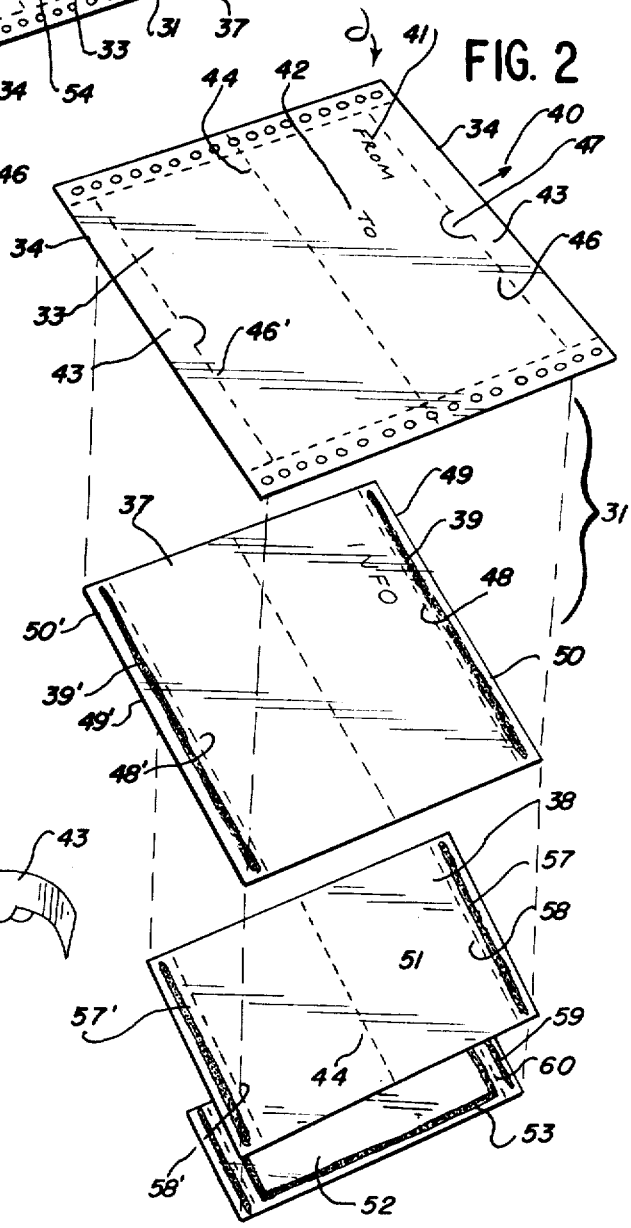
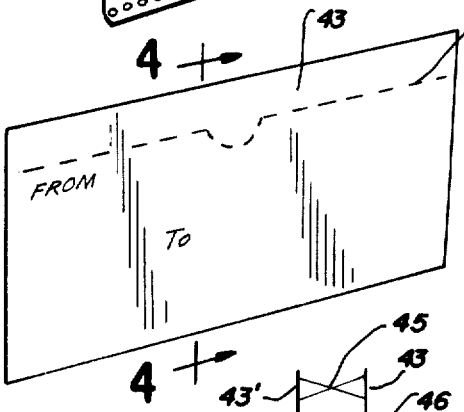
FIG. 3
FIG. 4
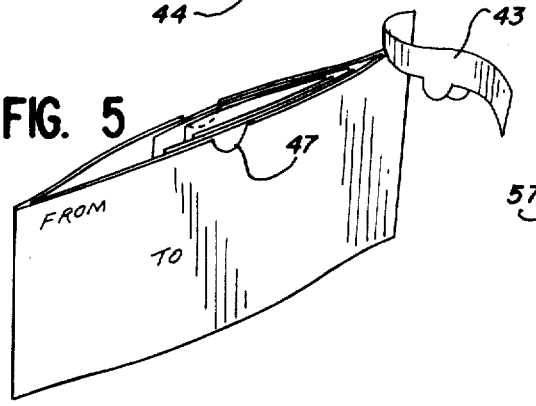
FIG. 5

FIG. 6
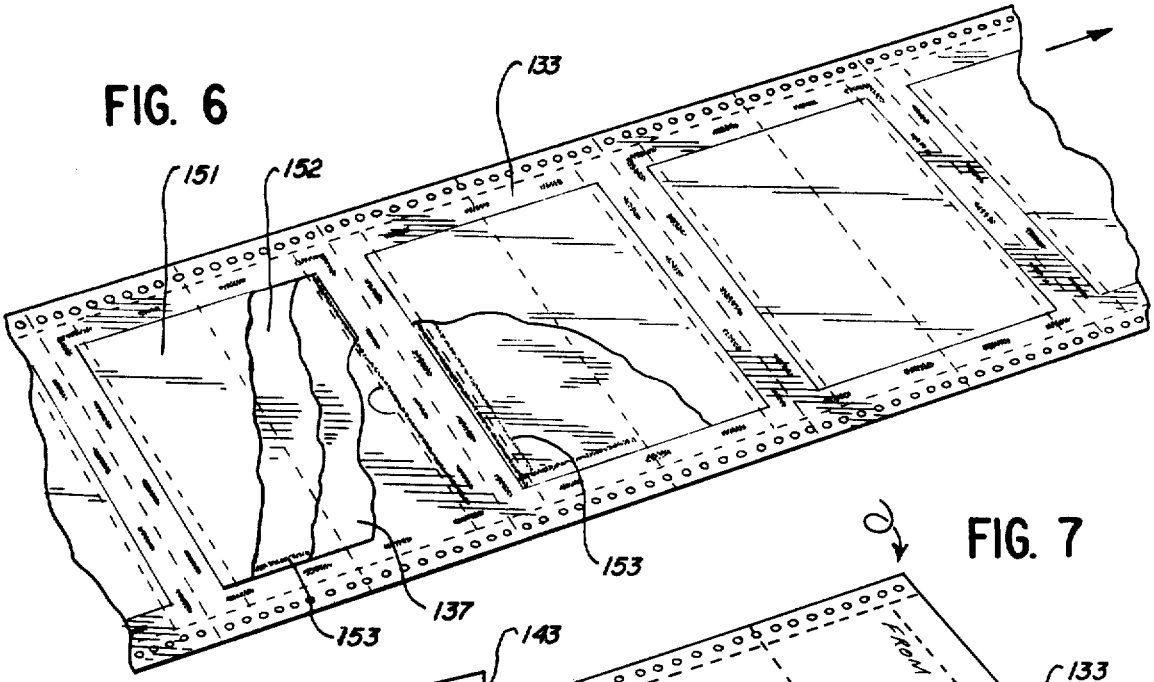
FIG. 7
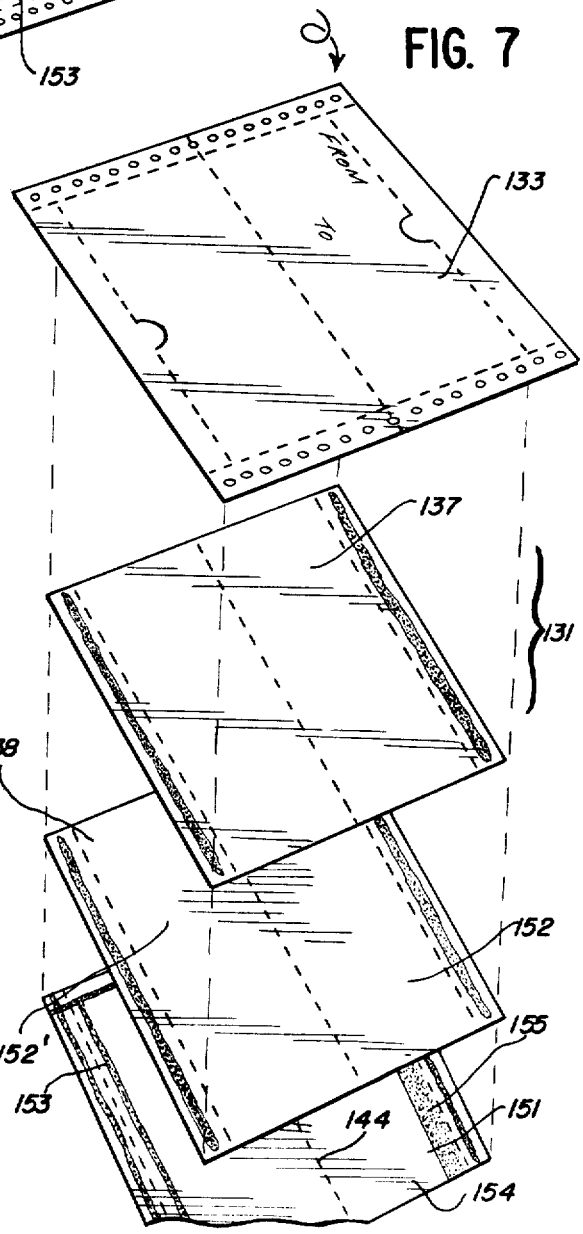
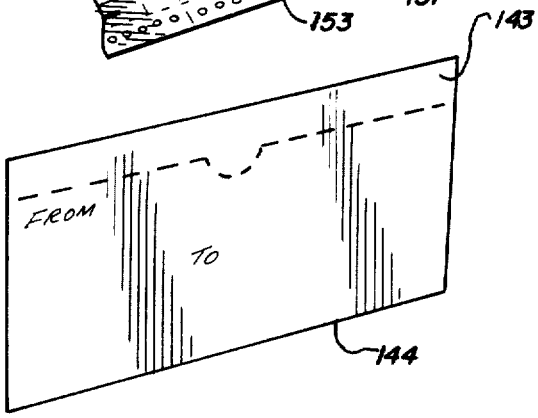
FIG. 8
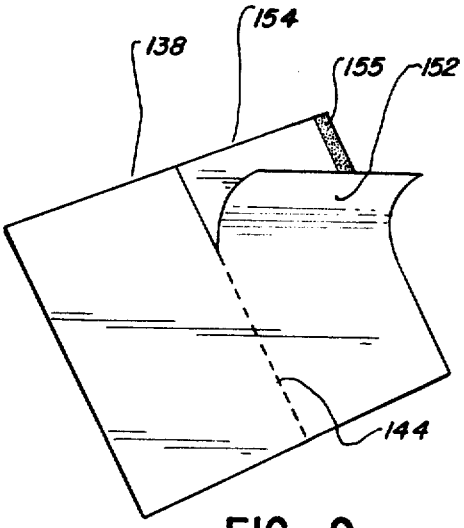
FIG. 9

FIG. 15
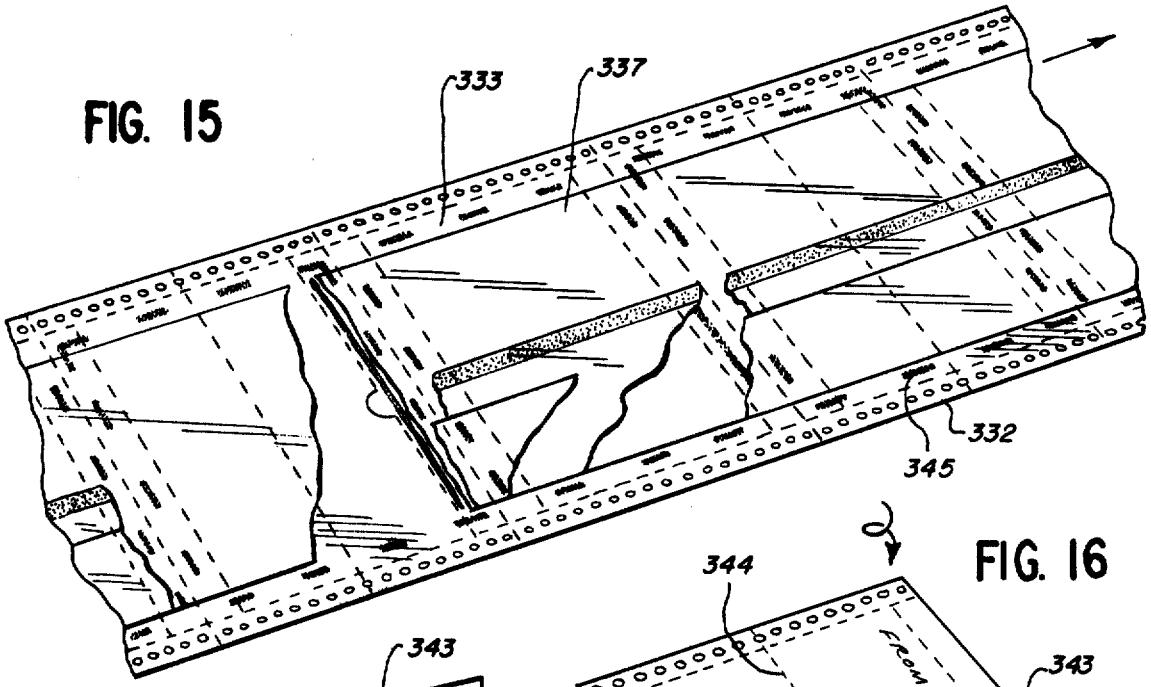
FIG. 16
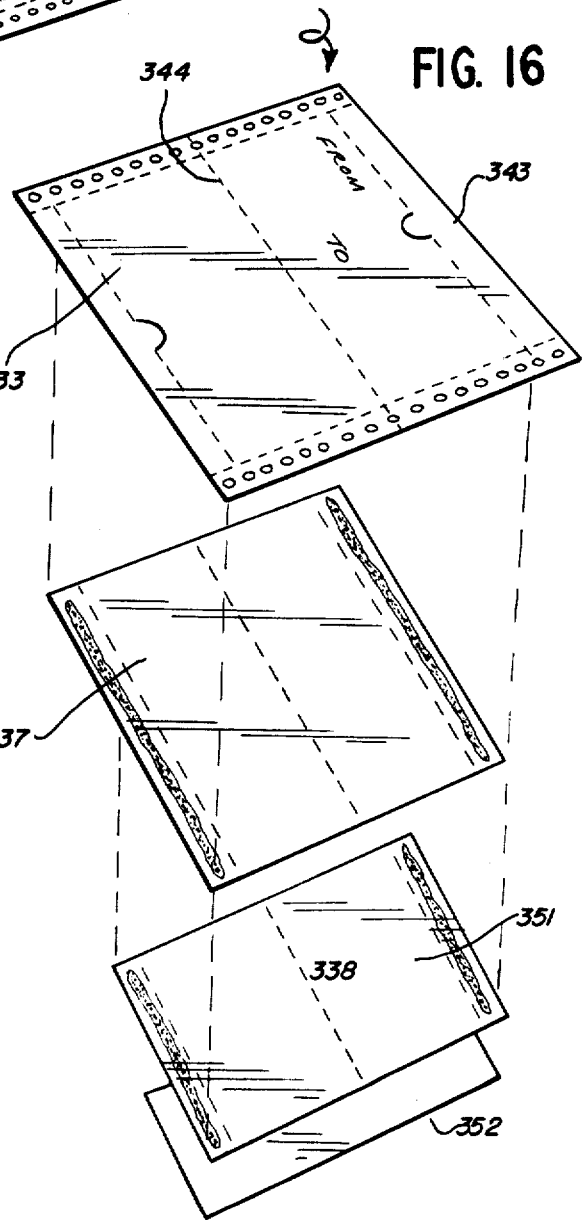
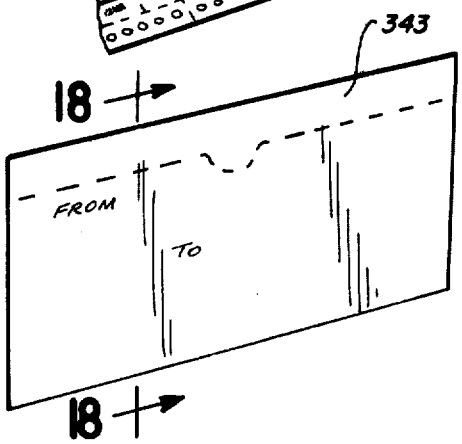
FIG. 17
FIG. 18
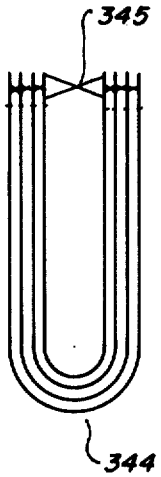

FIG. 19
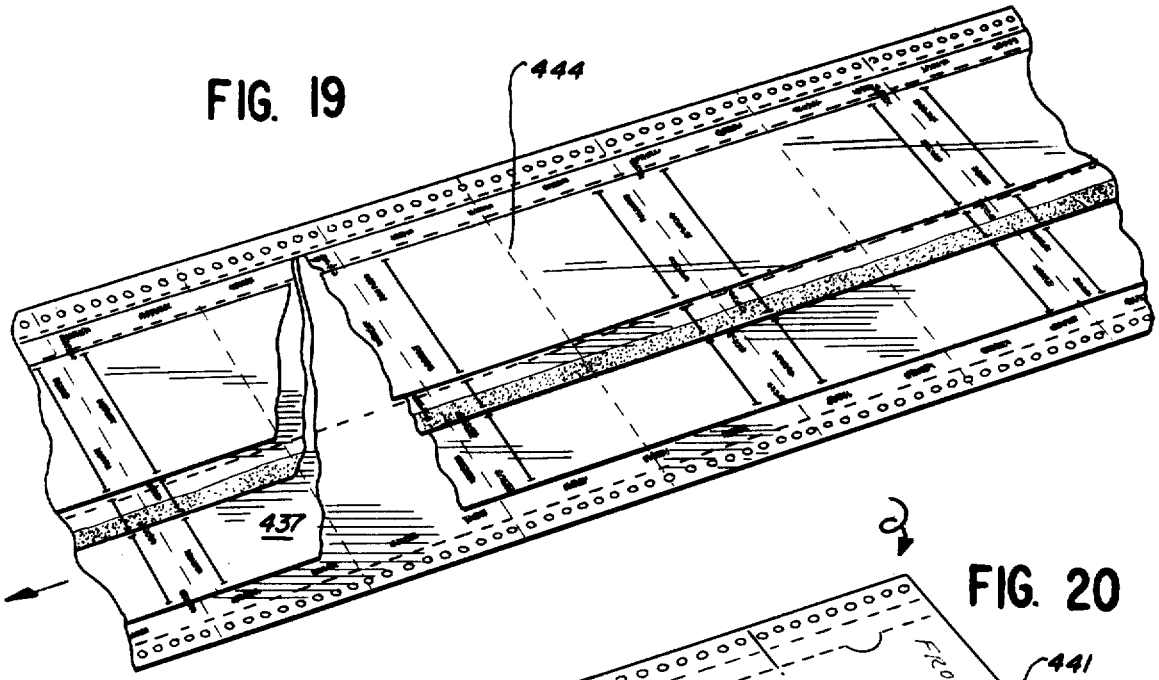
FIG. 20
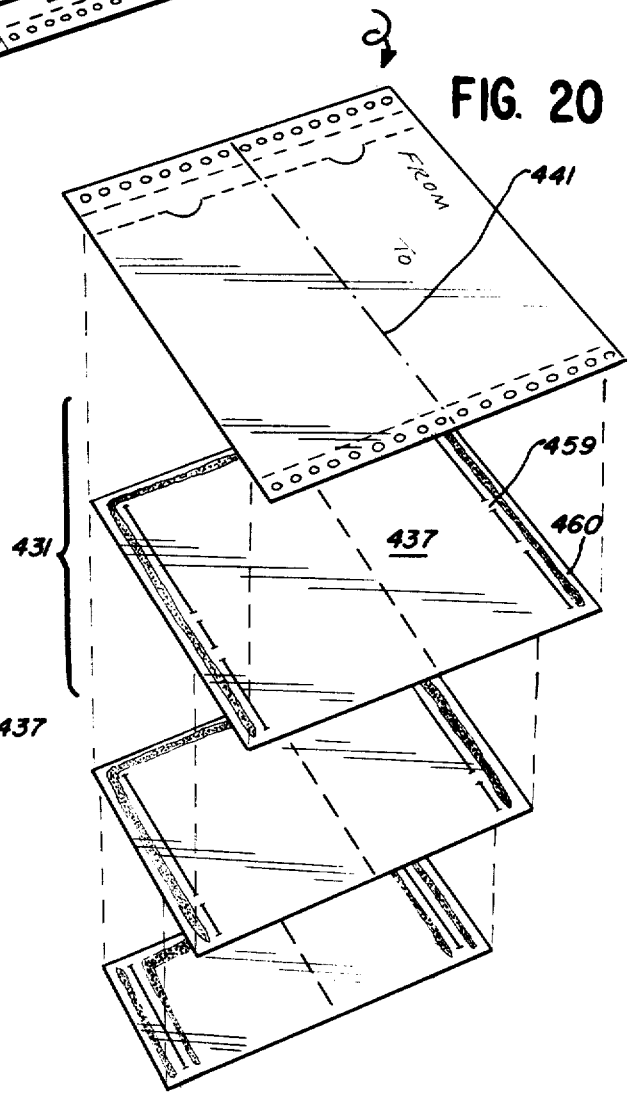
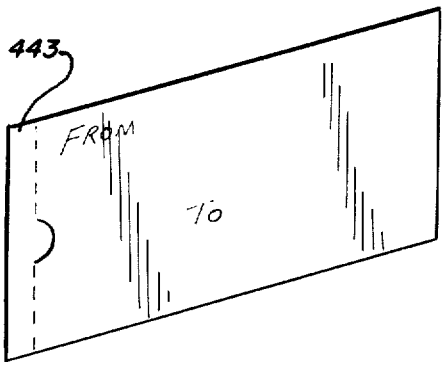
FIG. 21
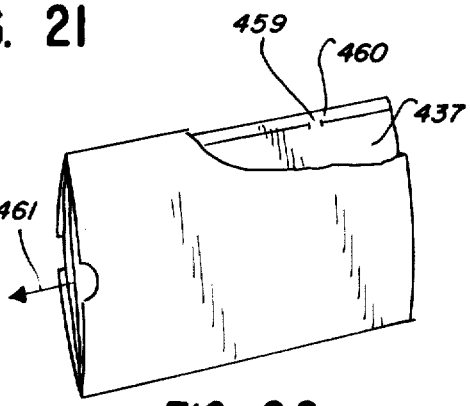
FIG. 22

MAILER

BACKGROUND AND SUMMARY OF INVENTION

This invention relates to a mailer—more particularly, a mailing piece produced in continuous, connected but separable fashion so as to be computer printed.

Since the 1960's, mailers have become increasingly used—as exemplified by the construction of U.S. Pat. No. 3,104,799. However, these have suffered from drawbacks—an important one being damage in the mail. For example, mailer forms with a dimension over 4¼" in height (web direction) suffer damage in handling in the mail. Although mailers 5½" in height are very popular in business systems, they are about the maximum height that does not suffer excessive damage. Mailers 6" in height, the maximum size allowed without a postage penalty charge, suffer such more damage than do 5½" mailers. Most damage results when the postal carrier bundles his letters. Envelopes higher than 4⅛", the height of the popular No. 10 conventional envelope, stick up above the pile and are bent over and torn by the rubber bands used to bundle the mail. Envelopes much higher than 4¼" such as 8½" and 11" are handled separately by the carrier and avoid much of this kind of damage.

However, envelopes over 6" in height suffer from the postal penalty charge and also from a long standing dissatisfaction by business users. Most business people prefer to send and receive mail that is near the No. 10 envelope size (4⅛"×9½").

According to the invention, the problem of damage in the mails is overcome by folding the mailer to a size where bending, tearing, etc. do not occur.

Although envelopes made of folded sheets are very old, the only relevant prior art to mailers appears to be U.S. Pat. No. 3,837,565 which discloses quite a number of folded mailer embodiments. Notwithstanding the long available teaching of computer printing of continuous envelope assemblies there is no teaching in the '565 patent of any construction which could be so used. For example, there is no teaching that the top edges of the interior plies be sealed to the envelope-forming ply to preclude hang-up in the printer.

According to the invention, a mailer is provided wherein the tops of interior plies are all connected to the envelope-forming ply to make possible reliable computer printing of a connected series of such mailers. The interior plies are generally coextensive with the envelope forming ply so as to provide the desired maximum of space for information. Shorting of the message ply (as in '565) is not a helpful approach to the problem because then there is no need for the larger envelope.

Further, according to the invention, the reproducing means, carbon paper, carbon spots, encapsulated ink, etc., are arranged relative to the envelope-forming ply that legible printing can only occur through the envelope forming ply—thereby eliminating the need for the windows of the '565 embodiments and making possible the use of interior plies that are generally as large as the envelope-forming ply. Utilizing the smaller interior plies frustrates the objective of the invention—to provide full information plies that go through the mail in a smaller assembly. In the '565 constructions, the window not only required the shorter interior plies but also printing on the uppermost of these plies, rather than on the envelope-forming ply.

An important feature of the invention is the provision of a line of potential folding which extends transversely of the continuous form, i.e., perpendicular to the control margins. This is in studied contrast to the '565 patent which has only one showing out of the plurality of embodiments wherein the fold line extends across the form. Through the use of such a line of potential folding, the invention provides a compact mailer that avoids the drawbacks of prior mailers in post office handling.

In the preferred constructions, the inventive mailer has a tear-off strip along the top to simultaneously open the envelope and release the connection of the interior plies from the envelope forming ply.

DETAILED DESCRIPTION

The invention is described in conjunction with a number of illustrative embodiments in the accompanying drawing, as follows

First Embodiment—Sheet 1

FIG. 1 is a fragmentary plan view of a connected series of mailer units constructed according to the teachings of this invention;

FIG. 2 is an exploded elevational view of one of the units of FIG. 1 and where the same is in inverted condition relative to that shown in FIG. 1;

FIG. 3 is a perspective view of a unit of FIG. 1 but in folded condition as it would pass through the mail;

FIG. 4 is a sectional view in schematic form such as would be seen along the sight line 4—4 of FIG. 3;

FIG. 5 is a perspective view of the mailer of FIG. 4 partially open by the recipient;

Second Embodiment—Sheet 2

FIG. 6 is a fragmentary perspective view of another form of the invention;

FIG. 7 is a view similar to FIG. 2 but of the embodiment of FIG. 6;

FIG. 8 is a perspective view of the folded mailer unit of FIGS. 6 and 7;

FIG. 9 is a perspective view of the return envelope portion of the unit of FIGS. 6–8 in the process of being opened;

Third Embodiment—Sheet 3

Figure 10:
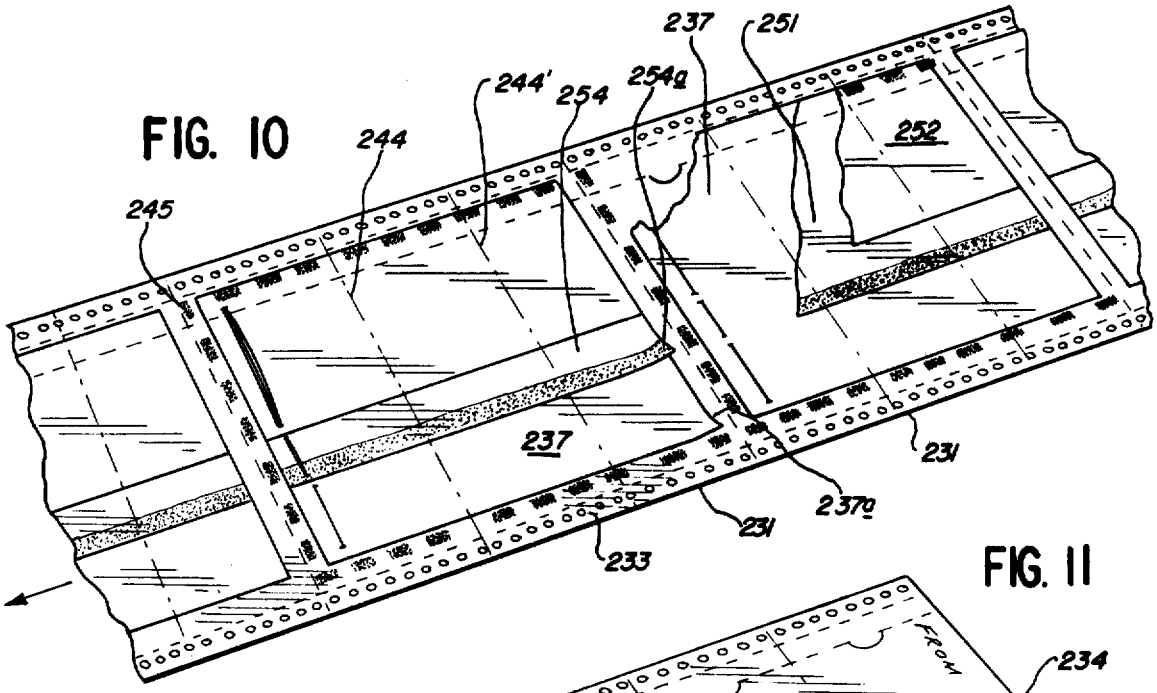
Figure 12:
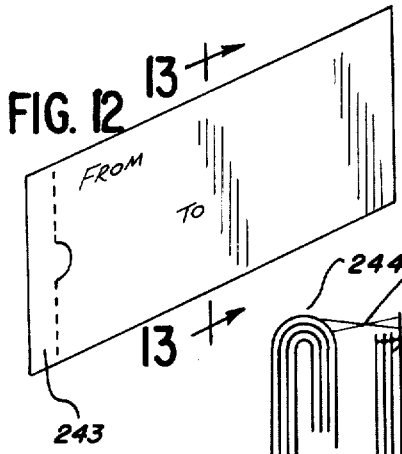
Figure 13:
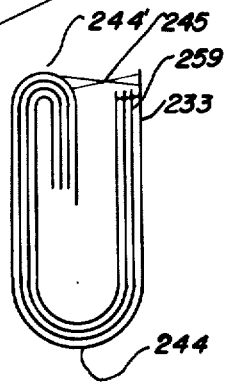
Figure 14:
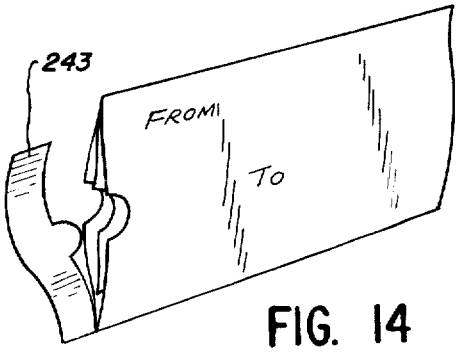
Figure 11:
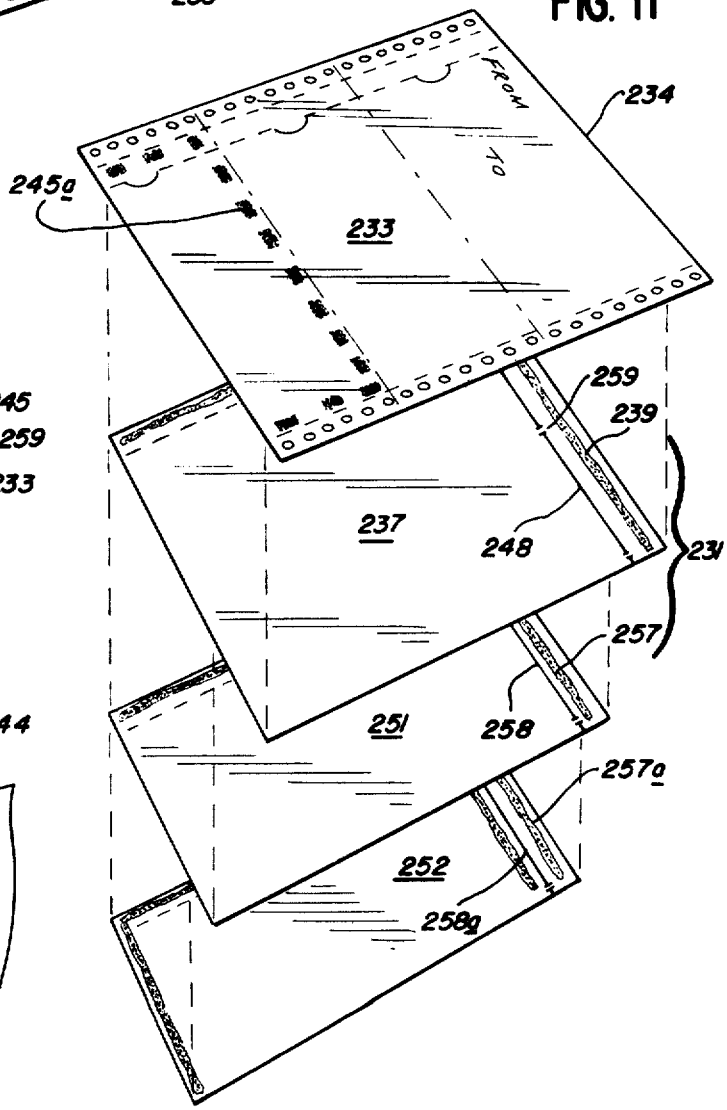

FIG. 10 is a fragmentary perspective view of another embodiment of the invention;

FIG. 11 is an exploded view of the embodiment of FIG. 10;

FIG. 12 is a perspective view of the folded unit;

FIG. 13 is a sectional view in schematic form as seen along the sight line 13—13 of FIG. 12;

FIG. 14 is a perspective view of the envelope of FIG. 13 in partially open condition;

Fourth Embodiment—Sheet 4

FIG. 15 is a fragmentary plan view of yet another embodiment of the invention;

FIG. 16 is an exploded view of the embodiment of FIG. 15;

FIG. 17 is a perspective view of the unit in folded form suitable for mailing;

FIG. 18 is a sectional schematic view along the line 18—18 of FIG. 17;

Fifth Embodiment—Sheet 5

FIG. 19 is a fragmentary plan view of still another embodiment of the invention;

FIG. 20 is an exploded view of one of the units of FIG. 19;

FIG. 21 is a perspective view of a folded unit suitable for mailing; and

FIG. 22 is a perspective view of an open envelope in the process of having the contents removed.

Referring now to the first drawing sheet which depicts the first and preferred embodiment of the invention, the numeral 30 designates generally a connected series of separable mailer units 31. In the illustration given, the units 31 are defined by lines of cross perforation 34 in a continuous web 33. In accordance with the usual procedure in producing business forms, the web 33 is equipped with at least one control margin as at 32 extending along the longitudinal side edge of the ply or web 33. The control margins 32 are characterized by the usual line holes as at 35 and are detachable after processing by virtue of longitudinally extending lines of perforation or severance 36 (see the right hand portion of FIG. 1).

Structurally, each unit 31 is identical to the others in the series with the exception of the adhesive used for mailing which will be described in greater detail hereinafter. The makeup of each unit can be more readily appreciated from a consideration of FIG. 2—to which reference will now be made.

The showing in FIG. 2 is of a single unit 31 but inverted from the condition illustrated in FIG. 1. The uppermost ply in FIG. 2 is the envelope-forming ply and is designated 33 to indicate that it was derived from the continuous web 33 by detachment along the edges defined by the lines of perforation 34. Connected to the envelope-forming ply 33 is an information or message-carrying ply 37. In the illustration given, this is positioned immediately adjacent the envelope forming ply 33 as also can be appreciated from the central portion of FIG. 1. Completing the unit 31 is a return envelope 38 and it will be appreciated that the inclusion of such an element is optional, although generally desired.

The information ply 37 is connected to the envelope-forming ply 33 by a line of adhesive 39 located adjacent the top edge of the unit 31. This can be appreciated from a consideration of FIG. 2 because the unit 31, when moving through the computer-printer as part of a connected series, moves in the direction of the arrow 40 and the imprinting occurs through the envelope-forming ply so as to conform to the sender and recipient indicia 41 and 42, respectively. Normally provided and represented fragmentarily and schematically are carbon spots or patches C (FIG. 1) on the underside of the envelope-forming ply 33 so as to transmit image-punch pressure through the envelope forming ply 33 to the underlying information ply 37 and any other plies provided within the unit 31. Alternatively, in accordance with established practice, carbon sheets or carbonless paper may be employed but again arranged so as to provide a legible image on the information ply 37 only when the impression is made on the outer face of the envelope forming ply 33. Also eliminated but conventionally provided is the outside or office ply which is used as a record copy and also serves to put the address only on the outgoing mailer ply 33.

The line of adhesive 39 which serves to connect the information ply 37 to the envelope forming ply 33 is positioned so as to be in alignment with a tear off portion 43 of the unit 31—compare FIGS. 2 and 5. Thus, when the tear off portion or strip 43 is removed, the information ply 37 is detached from its connection to the envelope forming ply 33.

As will be appreciated from a comparison of FIGS. 2 and 4, the unit 31 is folded on itself along a line of potential folding 44 (greatly exaggerated in FIG. 4) to achieve the smaller size mailer. This folding positions the envelope forming ply outwardly and brings the top and bottom edges (defined by transverse lines of perforation 34) into back to back relationship—again, see FIG. 4—with the inside plies sandwiched inbetween. These edges are united by means of an adhesive 45 which is laid down on the continuous web 33. In the specific illustration given, the adhesive 45 is of the stick-to-itself or self-sealing variety, and therefore the patches of adhesive have to be offset in going from one unit to the next so that adherence does not apply when the continuous series is zig=zag folded prior to computer printing. This is illustrated for example in FIG. 1 in the left hand portion relative to the patches 45 and 45" on adjacent units. It will be appreciated that other types and patterns of adhesives may be employed depending upon the circumstances such as heat activated, water moistenable, etc.

Referring again to FIG. 2, it is seen that the tear-off strip 43 is duplicated at the bottom edge of the unit as at 43" and is defined by the adjacent edge 34 and a transverse line of perforation as at 46" which corresponds to and, in the folded condition of FIG. 4 overlies and is aligned with the line of perforation 46 adjacent the top edge of the unit. Both the lines 46 and 46' are equipped with a thumb notch as at 47 (see also FIG. 5) to facilitate finger gripping of the contents of the mailer after the tear strip 43 has been removed.

As best seen in FIG. 2, the information ply 37 is also equipped with a line of perforation 48 adjacent to the line of adhesive 39 but spaced inwardly from the top or leading edge 49 of the information ply 37. In assembly, the line of perforation 48 underlies and is aligned with the line of perforation 46 so that the act of removing the tear strip 43 also removes the portion 50 of the information ply 37. It is within this portion 50 that the line of adhesive 39 is positioned so that the act of tear-strip removal frees the information ply 37 from its connection to the envelope forming ply 33.

In the illustration given, I find it advantageous to provide a second transverse line of adhesive as at 39' adjacent the bottom edge 49' of the information ply 37. This is removed also by virture of the fact that the line of perforation 48' defines a portion 50' that is removed incident to tear strip removal.

However, it is not necessary that the information ply 37 be connected to the envelope forming ply 33 along the bottom edges thereof inasmuch as a free bottom edge on the information ply 37 would not interfere with the processing of the connected series through the computer-printer. I prefer to have the information ply 37 be slightly shorter than the length of the envelope forming ply 33. This can be appreciated from the left hand portion of FIG. 1 where the bottom edge 49' of the information ply 37 is spaced a slight distance away or short of the transverse line of perforation 34. By this arrangement, undesirable tenting is avoided. The information ply can be cut short to eliminate tenting so that the short space could be either at the top or the bottom or divided between the two. However, when the number of plies is minimal or where tenting can be tolerated, the various plies can be coextensive in length—as is illustrated hereinafter with the fourth embodiment of the invention.

As indicated previously, it is desirable in most instances to provide a return envelope as at 38. The envelope 38 is made up of a front ply 51 and a back ply 52 (see the central portion of FIG. 1 as well). The front and back plies 51 and 52 are connected by a U-shaped band of adhesive 53 which lies wholly within the portion of the unit remaining after the tear strip 43 has been removed. The front ply 51 provides a flap portion 54 which extends beyond the bottom or rear ply 52 and is equipped with the usual band of moistable adhesive 55 for closing the envelope about the fold line 56.

The return envelope 38 is secured within the unit in the same fashion as the information ply 37. To this end, the return envelope 38 is equipped with transverse bands of adhesive as at 57 and 57' (see FIG. 2) which lie between the lines of perforation 58 and 58' respectively which define a portion of the tear off strip. The rear ply 52 is also similarly equipped as at 59 and 60 for the adhesive bands and lines of perforation repectively.

Manufacture and Operation of First Embodiment

In the practice of the invention, the basic web employed for processing is the continuous web 33 which ultimately provides the envelope forming ply also designated 33. In some instances, a second web may be advanced along with the web 33 so as to provide the conventional office copy after computer printing but before folding and mailing. Likewise, a third web (also not shown) may be employed so as to cover the interior plies but such is normally superfluous.

In the process of manufacture, the continuous web 33 is equipped with the control margins 32, the line holes 35, and the transverse lines of demarcation, i.e., perforation 34. Additionally, the web 33 is equipped with the transverse lines of perforation 46 and 46' (also defining the thumb tabs or notches 47).

Thereafter, the transverse lines of adhesive 39, 39' may be laid down either on the web 33 or the panels ultimately constituting the information plies 37. These panels are equipped with the transverse lines of perforation 48, 48' and are arranged for colinear relationship with the lines of perforation 46, 46'.

In similar fashion, the return envelope 38 may be fabricated out of a pair of plies or panels 51 and 52 which are united along three sides by the band of adhesive 53, the confronting face of the panel 51 being equipped with the lines of adhesive 57 and 57' and the lines of perforation 58, 58' for alignment with the lines of perforation 48, 48'. It will be appreciated that considerable variation in manufacture is possible depending upon the type of processing machinery, collator, etc. employed—the bands of adhesive being applied to either or both plies to be united. Also, the various steps of cutting, perforation, etc. may be altered in the sequence depending upon the nature of the processing machinery.

In like fashion, the envelope forming adhesive 45, 45' may be laid down on the web 33 at a convenient time during the processing. Also, in like manner, the transverse line of potential folding 44 may be installed at a convenient point in the processing. Normally, it is advantageous to produce this by a line of light perforation or scoring after all of the plies have been assembled so that there is assurance that the various fold lines will be strictly in alignment.

After the continuous series of connected units has been achieved by the manufacturer, the same are usually zig-zag folded and cartoned for shipment to the user, i.e., the business operation employing the computer having a business form print-out capability. The continuous forms are stepped through the computer-printer by virtue of the line holes 35 after which the control margins 32 are stripped by severance along the longitudinal lines of perforation 36. The now completed forms are directed through a burster which separates the continuous form into the individual units 31 (but without control margins) after which they are directed to a folder for folding about the line of potential folding 44 so as to bring the adhesive patches 45 or 45' into confronting relation and union. The thus completed, folded mailer is sent through the mail in the form seen in FIG. 3 and upon receipt, the recipient removes the tear-off strip 43 in the fashion indicated in FIG. 5 and thereafter is enabled to remove the detached contents by applying finger removal pressure through the thumb notch areas 47.

Thus, the invention provides a mailer form suitable for print-out by a computer that can then be folded to reduce its size for mailing to a convenient and conventional size without excessive length that it unusable for the message. It also provides an easy to open and extract-contents feature while providing positive registration of the form during computer printout. It also provides a tent-free structure. According to the preferred embodiment of the invention, there is a continuous top ply with carbon to image the ply below. The information ply is shorter (in the web movement direction) and narrower than the top ply 33. Two plies 51 and 52 form a top-open style return envelope which are shorter than the top ply 33. The plies 37, 51 and 52 which are shorter than the top ply 33 are cross glued in a stub at the top as at 43 and optionally at the bottom (as at 43'). This stub then becomes part of the top opening tear strip. The provision of the transverse line of potential folding 44 develops a convenient, conventional envelope size in a typical office folder. After folding, the adhesive 45, 45' is available along three edges to develop a sealed envelope assembly. The adhesive, as indicated, can be the self-stick variety, heat activated, remoistenable, pressure sensitive, etc.

Second Embodiment

Reference is now made to the second sheet of the drawing and inasmuch as many elements of this embodiment are identical to those of the first embodiment, much of the detailed description will be omitted. Where possible, like reference numerals will be employed to designate like elements but with the addition of 100.

More specifically, the embodiment of FIGS. 6–9 differs from that of FIGS. 1–5 in the structure and arrangement of the return envelope. Thus, the continuous web 133 of FIG. 6 (alternatively, the envelope forming ply 133 of FIG. 7) are identical to those depicted and described previously. Likewise, the information ply 137 is similarly constructed and arranged. However, the return envelope 138 is constructed of a front ply 151 and a rear ply 152 which are arranged differently than the corresponding plies of the first embodiment. It will be appreciated from a consideration of FIGS. 7 and 8 that the flap 154 runs transversely of the continuous web 133 rather than parallel thereto. This provides a return envelope that is not creased in the manner of the first embodiment when being sent through the mail on its outgoing trip. For example, in FIG. 2, the outbound return envelope is folded about the line 44 so that it itself has to be unfolded before the recipient of the mailer can return his check or other response.

In the second embodiment (of FIGS. 6–9), the return envelope 138 is folded along the line 144 which corresponds to the line of ultimate folding when the envelope is used for return of the response.

Additionally, the return envelope 138 has the advantage over that of the first embodiment of being printable in the computer printer with the address of the original sender because of its orientation within the unit 131. However, to make it with a minimum of equipment, it is necessary to provide an extension on the rear panel 152 as at 152' which requires detachment by the person making the response. Thus, in the illustration given, two panels 151 and 152 are provided in the same fashion and size as the message ply 137. The differences reside in the provision of the remoistenable band 155—none being needed in the message ply 137, and in the provision of the uniting band of adhesive 153.

In the operation of this embodiment of the invention, the unit 131 is processed through the computer printer as previously described and thereafter through the burster and folder to develop the outgoing mailer as seen in FIG. 8—equipped with the tear off strip 143. Top removal is again effected in the same fashion and for response, the recipient/responder removes the extraneous portion 152' as illustrated in FIG. 9—the perforations or scores along the line 144 serving a dual purpose in this instance.

The advantages of the transversely disposed form of return envelope can be attained without the need for removing a portion of the envelope but through the use of additional equipment in the manufacture of the mailer. For example, it is possible to "patch on" the rear panel 152 but of a shortened version and have the open end of the return envelope facing toward the bottom of the unit—thereby avoiding the possibility of catching the same on the computer-printer mechanism. Alternatively, again, with additional processing equipment, it is possible to position the shorter rear panel interiorily of the unit, again, so as to avoid printer hang-up.

Third Embodiment

An important distinction of this embodiment over those described previously is the provision of a plurality of fold lines as at 244 and 244' (compare FIGS. 10 and 13). In order to show the details more clearly, the view of FIG. 10 is reversed from the corresponding showings in FIGS. 1 and 6—and the tops so labeled. The plurality of fold lines makes possible the development of an acceptably small mailer from an even larger unit 231. However, this precludes a top opening mailer inasmuch as part of the information ply 237 would be destroyed. Thus, the embodiment of FIGS. 10–14 features a side opening envelope—see FIG. 14. Also, the arrangement of the glue patches are different from the preceding embodiments inasmuch as the adhesive bond 245 (see FIG. 13) extends from the underside of the envelope forming ply 133 along one edge to the outer side of the ply along the fold line 244'. In other words, and referring to FIGS. 10 and 11, the patch 245 on the underside of the continuous web 233 unites with the patches **245*a*** on the outer side of this envelope forming ply.

One other significant difference characterizes this third embodiment from the two preceding—this being in the manner of the connection of the interior plies 237, 251 and 252 to the envelope forming ply 237. Inasmuch as the tear off strip 243 is along the side rather than the top, I employ a rupturable connection in the form of very small ties or bonds as at 259 (see FIG. 11). These are occasioned by the need for having the various interior plies 237, 251, 252 connected to the envelope forming ply 233 along the top edge 234 thereof.

This again is done by bands of adhesive as at 239, 257 and **257*a*—see FIG. 11. However, inasmuch as the tear strip is not provided along the top, it is necessary to provide a means for disconnecting the interior plies from these adhesive connections. This is done, not as before in the form of a line of perforations as at 48 and 58 but rather by elongated slits interrupted by the narrow, easily rupturable bonds 259. In a sense, however, the elongated slits 248, 258 and 258*a*** perform the same function as their first embodiment counterparts in permitting detachment of the main body of the interior plies from the small stub provided to insure that all of the plies are connected along the top of the mailer.

On the other hand, it is not necessary that the interior plies be connected along the bottom of the mailer as can be appreciated from the looseness of the ply 237 illustrated as at **237*a* in FIG. 1 and the looseness of the flap 254 of the return envelope as at 254*a*—also in FIG. 10**.

Fourth Embodiment

The fourth embodiment is seen on the fourth drawing sheet and is illustrated in FIGS. 15–18. The essential difference between the construction of this embodiment and the first illustrated embodiment is the continuous nature of the interior plies. On occasion, this can cause tenting problems but many applications can tolerate a small amount of tenting in view of the lower cost of manufacture of forms using continuous plies and where fewer plies are to be used in the mailer.

In FIG. 15, the continuous web 333 again provides the envelope forming ply—also designated 333 in FIG. 16. Immediately adjacent the web 233 is a continuous ply 337 which ultimately provides the information ply also designated 337 and which, as in the previous embodiments, is narrower than the envelope-forming ply 333. The overlap of the continuous envelope-forming ply 333 provides the control margins 332 and additionally a space for the adhesive employed for (sealing after) folding as at 345.

In this fourth embodiment, the tear off strip 343 is again provided along the top of the unit 331 with the information ply 337 and the return envelope 338 being equipped with stub portions for adhesive securement thereto, consisting as in the first and third embodiments of front ply 351 and rear ply 345.

In the manufacture of this embodiment of the invention, continuous webs can be employed and suitably equipped with adhesive and cross perforated in a continuous fashion so as to minimize the complexity and expense of the machine employed.

In a fashion analagous to that described in conjunction with the first embodiment, the plies of the unit 331 are equipped with a line of potential folding as at 344—also depicted schematically in FIG. 18.

After manufacture, the unit is processed and performs in the manner exactly as described in conjunction with the first embodiment.

Fifth Embodiment

This embodiment which is found on the fifth sheet of the drawings includes FIGS. 19–22. It corresponds, in essence, to the third embodiment but utilizing only a single transverse fold line as at 444. As was the case with the third embodiment, the mailer is a side opening variety as at 443 (see FIG. 21). This necessitates the use of the small ties or bonds as at 459 to connect the main body 437, for example, to the stub 460 adjacent the top of the unit 431. As can be most readily appreciated from FIG. 22, the removal of the inner plies—illustrated by the information ply 437 in the direction of the arrow 461, results of the rupture of the small ties 459.

In the other respects, the details of this embodiment are very much the same as the first embodiment in view of the fact that there is but a single transverse line of potential folding as contrasted to the plurality in the third embodiment.

While in the foregoing specification a detailed description of various embodiments of the invention have been set down for the purpose of illustration, many variations in the details hereingiven may be made by those skilled in the art without departing from the spirit and scope of the invention.

I claim:

1. A connected series of separable mailer units wherein each unit includes an envelope-forming ply having a control margin along at least one longitudinal side edge and at least one additional ply on said envelope forming ply adapted to serve as a message ply or the like, said additional ply being connected to said envelope-forming ply along the top edge thereof and having a length to substantially extend over the length of said envelope-forming ply, each unit being equipped with at least one line of potential folding extending transversely of said control margin to permit said unit to be folded into at least two parts with said additional ply being present in both of said two parts whereby a large message-bearing ply is provided in an envelope which is approximately one-half the size of said message-bearing ply when said unit is folded into two parts, adhesive means on each unit for securing said unit in reduced area form after the same has been folded about said line of potential folding with said envelope-forming ply disposed outwardly, image transfer means associated with said plies, and tear strip means along one of the edge of said envelope fforming ply to permit removal of said additional ply when the same is in folded condition.

2. The structure of claim 1 in which said additional ply is slightly shorter than said envelope forming ply.

3. The structure of claim 1 in which said tear strip means is along the top and bottom of said envelope-forming ply.

4. The structure of claim 3 in which said additional ply is adhesively connected to said envelope-forming ply between said top edge and a line defining said tear strip means.

5. The structure of claim 4 in which additional plies are provided in said unit to form a return envelope.

6. The structure of claim 1 in which said tear strip means is provided along one of the longitudinal side edges of said unit, said additional ply being separable from said envelope-forming ply adjacent the top thereof by rupturing small integral bonds in said additional ply incident to removal from the folded unit.

7. The structure of claim 6 in which two lines of potential folding are provided.

8. The structure of claim 1 in which a return envelope is provided in each unit with the length thereof disposed lengthwise of said unit.

9. The structure of claim 1 in which a return envelope is provided in each unit with the length thereof disposed transversely of said unit.

10. A connected series of multi-ply mailer units separable into individual units each capable of being transversely folded into a size approximating a No. 10 envelope so as to avoid postal damage, each unit including an envelope-forming ply having a control margin along at least one longitudinal side edge and an information ply approximately as long as said envelope-forming ply and connected thereto along the top edge to prevent interference during computer printout, and tear-off means along one edge for removal of the folded information ply from the folded, sealed envelope forming ply, each unit being equipped with at least one line of potential folding extending transversely of said control margin to permit said unit to be folded into at least two parts with said information ply being present in both of said two parts whereby a large message-bearing ply is provided in an envelope which is approximately one-half the size of said message-bearing ply when said unit is folded into two parts.

11. The structure of claim 10 in which the connection of said information ply to said envelope-forming ply provides a stub, and a return envelope is detachably connected to said stub.

12. The structure of claim 11 in which said stub is removed with said tear off means.

13. The structure of claim 11 in which said information ply and return envelope are connected to said stub by easily rupturable, integral ties.

14. The structure of claim 11 in which said return envelope has a flap equipped with a band of adhesive thereon with said flap being coplanar with the front of said return envelope.

15. The structure of claim 14 in which the length of said band of adhesive is parallel to the length of said series.

16. The structure of claim 14 in which the length of said band of adhesive to transverse to the length of said series.

17. The structure of claim 10 in which said information ply terminates short of the top and/or bottom edges of said envelope forming ply to avoid tenting and adhesive for securing said unit in folded condition is provided in the area of said envelope forming ply between the edges of said information ply and the adjacent top and bottom edges of said envelope-forming ply.

18. The structure of claim 10 in which said information ply is continuous in length with said envelope forming ply to permit continuous web fabrication, said information ply being equipped with adhesive adjacent the top and bottom edges thereof to maintain said unit in folded condition.

19. A connected series of mailer units computer printable and thereafter separable into individual units comprising a continuous envelope-forming ply equipped with equally longitudinally spaced lines of potential severance to provide said individual units, an information ply for each unit extending substantially between said spaced lines and connected to said envelope forming ply at the end of said information ply first entering said computer printer, a line of potential folding between said lines of potential severance to permit each unit to be folded into two parts with said information ply being present in both of said two parts whereby a large message-bearing ply is provided in an envelope which is approximately one-half the size of said message-bearing ply when said unit is folded into two parts, and adhesive means on each unit for maintaining the same in folded condition for mailing.

20. A connected series of mailer units computer printable and thereafter separable into individual units comprising a continuous envelope-forming ply equipped with equally longitudinally spaced lines of potential severance to provide said individual units, an information ply for each unit extending substantially between said spaced lines and connected to said envelope forming ply at the end of said information ply first entering said computer printer to provide a forward stub, a line of potential folding between said lines of potential severance to permit each unit to be folded into two parts with said information ply being present in both of said two parts whereby a large message-bearing ply is provided in an envelope which is approximately one-half the size of said message-bearing ply when said unit is folded into two parts, adhesive means on each unit for maintaining the same in folded condition for mailing, and means in said unit for detaching said information ply from said sub incident to opening said folded envelope.

21. The structure of claim 20 in which said unit is equipped with a tear off strip including said stub.

22. The structure of claim 20 in which said unit is equipped with image reproducing means arranged and constructed so as to provide readily intelligible images only when printed from the side of said envelope forming ply opposite that connected to said information ply.

* * * * *